United States Patent [19]

Kalashnikov et al.

[11] 4,275,988

[45] Jun. 30, 1981

[54] AXIAL OR WORM-TYPE CENTRIFUGAL IMPELLER PUMP

[76] Inventors: Leonid F. Kalashnikov, ulitsa 50 let VLKSM, 2, kv. 165, Kaliningrad Moskovskaya oblast; Vladimir N. Kudiarov, Leningradskoe shosse, 2, kv. 40, Khimki Moskovskaya oblast; Georgy M. Kushnir, Kronshtadsky bulvar, 34, korpus 2, kv. 78; Anatoly S. Shapiro, Raketny bulvar, 12, kv. 7, both of Moscow; Rjury I. Konstantinov, ulitsa 50 let VLKSM, 5/16, kv. 110, Kaliningrad Moskovskaya oblast; Vadim V. Nikolaev, ulitsa Mendeleevskaya, 5, Klyazma Moskovskaya oblast; Vladimir K. Kunets, prospekt Mira, 180, kv. 12, Moscow, all of U.S.S.R.

[21] Appl. No.: 968,727

[22] Filed: Dec. 13, 1978

[51] Int. Cl.[3] ..... F04D 3/02; F04D 29/38

[52] U.S. Cl. ..... 415/74; 415/213 C; 416/176

[58] Field of Search ..... 415/72, 73, 74, 213 C; 416/176, 177

[56] References Cited

U.S. PATENT DOCUMENTS

| | | | |
|---|---|---|---|
| 2,195,902 | 4/1940 | Pezzillo | 415/72 |
| 3,163,119 | 12/1964 | Huppert et al. | 415/72 |
| 3,299,821 | 1/1967 | Silvern | 416/175 |
| 3,442,220 | 5/1969 | Mottram et al. | 416/176 X |
| 3,723,019 | 3/1973 | Berman | 415/73 X |
| 4,150,916 | 4/1979 | Tsutsui et al. | 415/143 |

FOREIGN PATENT DOCUMENTS

| | | | |
|---|---|---|---|
| 261183 | 5/1970 | U.S.S.R. | 415/143 |
| 577317 | 11/1977 | U.S.S.R. | 415/73 |
| 596733 | 2/1978 | U.S.S.R. | 415/72 |

*Primary Examiner*—Leonard E. Smith

*Attorney, Agent, or Firm*—Steinberg & Raskin

[57] ABSTRACT

The pump of the present invention has a housing which accommodates an axial impeller set on the pump drive shaft. The impeller has a hub which carries a number of the helical impeller blades held in position thereto and defining a plurality of blade channels for the liquid being handled to pass. An additional intake axial impeller with the helical impeller blades is set on the pump drive shaft before the axial impeller as viewed in the direction of liquid flow, said additional intake axial impeller having its outside diameter smaller than the outside diameter of the axial impeller, and the lead of helix of the impeller blades thereof is lower than the lead of helix of the impeller blades of the axial impeller at the entry thereof, while the ratio between the outside diameter of the additional intake axial impeller and the outside diameter of the axial impeller, and the ratio between the lead of helix of the impeller blades of the additional intake axial impeller and the lead of helix of the impeller blades of the axial impeller across the outside diameter of both respective impellers are selected so as to provide for high pump suction capacity.

13 Claims, 5 Drawing Figures

AXIAL OR WORM-TYPE CENTRIFUGAL IMPELLER PUMP

This invention relates generally to the art of pump construction and has particular reference to various designs of vane pumps.

The invention can find utility when applied in chemical and petroleum-refining industries, land reclamation practice, and some other fields, but to most advantage the present invention can be used in machine building for power engineering industry, ship-building, aerospace engineering, namely, in high-delivery pumps designed to operate at low suction head, or in high-speed pumps.

One of the most important pump performance characteristics is its suction capacity expressed in suction specific speeds;

$$C = 5.62 \frac{n\sqrt{Q}}{\Delta h^{\frac{3}{4}}} \quad (1)$$

where n is the speed of pump drive shaft, rpm;

Q is the volumetric flow of the liquid being handled (or else pump delivery), $m^3/s$;

$\Delta h$ (NPSH) is the net positive suction head of the pump, m.

As a matter of fact, the larger the magnitude of C the better the pump suction capacity.

It is common knowledge that the speed of the pump drive shaft determines the pump overall size and mass, while its delivery is responsible for the number of pumps required and the suction head governs the capital investment involved. Thus, a two-fold increase in pump suction capacity with a constant suction head enables the speed of pump drive shaft to be increased two times which, in turn, involves a three- to six-fold reduction of pump size and mass, whereby the manufacturing cost of pumps having the same delivery capabilities is significantly reduced. The current trend to increase the unit capacity of power plants involves the provision of pumps of ever-increasing delivery which require higher suction head. However, provision of higher suction head in high-delivery pumps is restricted due to their high costs. Thus, a two-fold increase in pump suction head enables one to manage with a single high-delivery pump instead of making use of four pumps having an equivalent total delivery, as well as to cut down capital investment necessary for provision oa required suction head by at least three times.

Thus, the up-to-date pump construction industry is in urgent need of higher suction capacity pumps.

Whenever the pump suction capacity proves to be inadequate cavitation sets up in the pump which reduces the head and efficiency, gives rise to cavitation erosion of the impeller flow-through duct and to fluctuations of the pressure and the rate of liquid flow effective in the intake and exhaust pump lines.

The specificity of the problem resides in the fact that any increase in pump suction capacity as a rule affects the pump efficiency which involves considerable increase of power consumption. That is why high suction capacity pumps have as a rule but low efficiency, whereas high efficiency pumps are characterized by low suction capacity.

Known in the present state of the art are pumps featuring high suction capacity ($C \approx 4000$) (cf., e.g., "Cavitation in vane pumps" by Stripling, Tr. ASME Ser. D, No. 3, 1962).

The abovesaid known pump comprises an axial impeller set on the drive and having a hub carrying helical impeller blades, the design of the blades lengthwise the impeller radius obeying the law expressed in the following formula:

$$r.tg\beta = Const,$$

where r is the running value of the impeller radius, and $\beta$ is the angle of blade incidence bounded by the plane passing at right angles to the pump drive shaft and the plane tangential to the impeller blades.

The suction capacity of that pump is increased due to a larger cross-sectional area of the flow-through duct thereof and a reduced angle of incidence of the impeller blades, and as a result of a lower flow coefficient ($\phi$) at the impeller entry defined as a ratio between the axial velocity ($C_a$) of the flow of liquid and the peripheral speed (U) of the impeller measured at the outside diameter thereof; in this case said increase in the cross-sectional area of the pump flow-through duct is attained by virtue of enlarging the impeller outside diameter and a maximum reduction of the hub diameter permissible from the standpoint of its strength. This ensures a reduced axial component of the liquid flow velocity and a minimum drop of static pressure in the flow of liquid which results in a higher suction capacity of the pump.

However, the above pump has but low efficiency ($\eta \approx 0.5$) which is accounted for by a lower value of the flow coefficient ($\phi \leqq 0.1$) due to an increased cross-sectional area of the pump flow-through duct, a reduced value of the axial velocity ($C_a$) of the liquid flow and a separation flow pattern in the impeller flow-through duct.

Other prior-art vane pumps are known to feature high value of efficiency ($\eta = 0.75$ to 0.9) (cf. "Centrifugal and axial-flow pumps" by A. I. Stapanov, Mashgiz Publishers, M., 1960, pp. 141–164/in Russian/).

The above-mentioned known pump has a housing accomodating an impeller set on the drive shaft, said impeller having a hub carrying the blades featuring the free-vortex design lengthwise the impeller radius. The development of the cylindrical sections of said blades establishes a cascade of aerodynamic airfoils having relatively large angle of incidence, which is in fact the angle between the chord of the airfoil and the front of the air-foil lattice, corresponding to an increased flow coefficient ($\phi > 0.2$).

However, said pump is featured by a low suction capacity ($C \approx 1000$) which owes to relatively high axial velocities ($C_a$) of the liquid flow due to a reduced cross-sectional area of the impeller flow-through duct.

Attempts to resolve a contradictory problem of simultaneously attaining high suction capacity and large efficiency of the pump led one to develop a vane pump (cf. U.S. Pat. No. 3,299,821), whose housing accommodates an axial impeller set on the pump drive shaft before the centrifugal impeller as viewed in the direction of the flow of liquid, said axial impeller having a hub carrying the impeller blades held thereto and establishing a number of divergent blade channels.

The liquid-flow-through duct of the axial impeller comprises two portions located successively along the direction of the liquid flow, viz., a cavitation portion and a pressure portion, featuring the angles of blade incidence smoothly increasing from the impeller entry towards the exit thereof. In order to provide for a minimum axial impeller length, some theoretical relationships have been substantiated to establish the law of variation of the angle of blade incidence lengthwise the impeller in the direction of the liquid flow, said relationships being aimed at meeting the prerequisite of providing stall-free flow of liquid across the width of the blade channels, the cavitation section of the flow-through duct ensuring a higher suction capacity, and the pressure section, a preset head of the pump. Such a constructional arrangement of the axial impeller flow-through duct contributes to a simultaneous attainment of high pump suction capacity and high efficiency thereof.

One more design of a vane pump is known in the art (cf. the paper "Studies into high-pressure screws having double-row blades" by D. N. Contractor and R. I. Atter in a journal "Hydronautics", Inc., NASA CR-113890, 1969), wherein an axial impeller having helical impeller blades is set on the pump drive shaft before the axial impeller as viewed along the direction of liquid flow, said helical-blade axial impeller providing for high pump suction capacity and a minimum suction head required for cavitation-free operation of the impeller building up a preset head.

Such a constructional arrangement of the pump makes it possible to select the designed impeller operating conditions at higher values of the flow coefficient ($\phi > 0.2$), which provides for high pump efficiency.

However, the afore-described known constructional arrangements are characteristic of only the heretofore available prior art as concerned with the development of the problem of attaining simultaneously high pump suction capacity and high efficiency thereof, which of course may by no means be considered as an unsurpassed one. In particular, further increase in the pump suction capacity will result in a reduced intensity of cavitation erosion attacking its flow-through duct and a lower level of liquid pressure fluctuation and flowrate in the pump intake and exhaust lines.

It is a principal object of the present invention to provide a pump possessing substantially higher (1.5 to 2 times) cavitation characteristics as compared with the known pumps.

It is another object of the present invention to provide high values of pump efficiency ($\eta = 0.75$ to 0.9) within a broad range of head values ensured by the pump.

It is one more object of the present invention to increase the resistance of the axial impeller to cavitation erosion and reduce the fluctuations of the pressure and flowrate of the liquid being handled.

It is a further object of the present invention to provide a possibility of improving the suction capacity of pumps now in current use.

Among other objects of the present invention there may be noted an improved production effectiveness of the pump axial impeller.

In keeping with the foregoing and other objects the essence of the present invention resides in that in a vane pump whose housing accommodates an axial impeller set on a drive shaft, said axial impeller comprising a hub which carries helical impeller blades held in place thereto and establishing a plurality of blade channels for the liquid being handled to pass, according to the invention provision is made therein for an additional intake axial impeller having helical impeller blades and set on the drive shaft before the main axial impeller as along the direction of the liquid flow, said additional impeller featuring an outside diameter smaller than the outside diameter of the main axial impeller, and the lead of helix of the impeller blades of said additional intake axial impeller is lower than the lead of helix of the impeller blades of the main axial impeller effective at the entry thereof, the ratio between the outside diameters of the respective additional intake axial impeller and the main axial impeller, as well as the ratio between the leads of helix of the impeller blades of the respective additional intake axial impeller and the main axial impeller across the outside diameters of the impellers are adopted accordingly so as to provide for high pump suction capacity.

Such a constructional arrangement of the pump adds much to the suction capacity thereof which can be attributed to the formation of an enlarged radial clearance between the outside diameter of the additional intake axial impeller and the inside diameter of the pump housing. Thereby the flow of liquid is divided into two flows at the entry of the additional intake axial impeller, of which one flow passes through said clearance and the other flow, through said impeller. Making analysis into the relation (1) one finds out that when the volumetric flow of the liquid being handled is reduced, there is required a lower net positive suction head (NPSH) for the additional intake axial impeller to operate without cavitation stalling, with the known preset drive shaft speed and the value of the suction specific speeds, whereas for the pump as a whole any decrease in the value of the NPSH, with the known preset values of the volumetric flow of the liquid being handled and of the pump shaft speed results in a considerable increase in its suction capacity. Resorting to some simple calculations one can demonstrate that an increase in the pump suction capacity can be evaluated proceeding from the expression (2).

$$C' = C(D/D') \quad (2),$$

where

C' is the suction specific speeds of a pump with an additional intake axial impeller;

C is the suction specific speeds of a pump without an additional intake axial impeller;

D' is the outside diameter of an additional intake axial impeller;

D is the outside diameter of the axial impeller.

It is common knowledge that every axial impeller is characterized by an optimum lead of helix of the impeller blades a across the outside diameter thereof, which provides for maximum suction capacity.

Therefore, proceeding from the principle of geometric similarity the lead of helix of the impeller blades of the additional intake axial impeller across the outside diameter thereof must be selected so as to suit an increased outside diameter of the additional intake axial impeller.

Moreover, the additional intake axial impeller builds up a suction head that provides for cavitation-free operation of the axial impeller, thus rendering the cavitation erosion of the impeller flow-through duct less intense and the pump less liable to exhibit liquid pressure and flow-rate fluctuations.

It is recommendable that the outside diameter of the additional intake axial impeller be invariable as along its length in the meridional plane thereof and be less than the outside diameter of the axial impeller by 10 to 50 percent, whereas the lead of helix of the impeller blades of the additional intake axial impeller is recommended to be by 10 to 50 percent less than the lead of helix of the impeller blades of the axial impeller at the entry thereof.

The above ratios have been obtained experimentally and prove to be optimum with the outside diameter of the additional intake axial impeller remaining constant. When the outside diameter of the additional intake axial impeller is reduced by less than 10 percent of the outside diameter of the axial impeller, the effect of increasing the pump suction capacity is much lower. The restriction of a reduction of the diameter of the additional intake axial impeller to 50 percent is due to the fact that the additional intake axial impeller must ensure higher suction head upstream of the axial impeller so as to provide for said impeller to operate without cavitation stalling. Said suction head substantially diminishes in response to a reduction of the outside diameter of the additional intake axial impeller by more than 50 percent, which results in cavitation stalling of the pump.

It is expedient that the outside diameter of the additional intake axial impeller and the lead of helix of the impeller blades of the additional intake axial impeller be made decreasing lengthwise said impeller in the meridional plane thereof as against the flow of liquid being handled, taking into account that, as ensues from the expression (2), the pump features maximum suction capacity at a minimum possible outside diameter of the additional intake axial impeller.

The additional intake axial impeller can be represented as a plurality of elementary axial impellers arranged sequentially, each of them being made according to the present invention. Besides, each preceding elementary axial impeller as along the direction of the liquid flow is in fact an additional intake impeller for the following elementary axial impeller. Thus, a minimum NPSH value is required for the initial elementary intake axial impeller to operate without cavitation stalling, whereas for the next elementary axial impeller the operation free from vacitation stalling is ensured both by the NPSH value and by the suction head produced by the initial elementary intake axial impeller, and so-on.

On the whole, pump operation free from cavitation stalling is ensured at a substantially lower NPSH value which is defined by the operating conditions of the first elementary intake axial impeller as along the direction of the liquid flow.

It is desirable that the lead of helix of the impeller blades of the additional intake axial impeller be selected in keeping with the following relation:

$$S_i' = (0.75 \text{ to } 1.25)\frac{D_i' + D_i'}{D + d} \cdot S \qquad (3),$$

where $S_i'$, $D_i'$, $d_i'$ are the running values of the lead of helix of the impeller blades of the additional intake axial impeller, of the outside diameter thereof and of the diameter of its hub, respectively;

S, D, d are the values of the lead of helix of the impeller blades of the axial impeller, of the outside diameter thereof and of the diameter of the hub of said impeller at the entry thereof, respectively.

The relation (3) is essentially a mathematical expression of the geometric similarity of all elementary axial impellers which constitute, as a whole, the additional intake axial impeller, the average diameter of every elementary axial impeller being adopted as the characteristic linear dimension thereof. The range of values of the constant factor (0.75 to 1.25) is derived from experimental findings, said range ensuring some small deviation from the pump maximum suction capacity corresponding to the constant factor equal to unity.

In some particular cases the additional intake axial impeller is recommended to be applied in the booster stage.

Proceeding from the requirements of pump layout, the additional intake axial impeller may be spaced somewhat apart from the axial impeller so that a required excess of the suction head developed by the additional intake axial impeller, over the hydraulic losses occurring in the transient section must be provided. In this case the intake axial impeller is expedient to be used as the booster stage impeller. In particular, such a constructional arrangement of the pump is practicable when updating the existing pumps now in current use in order to increase the suction capacity thereof.

It is likewise desirable that the liquid flow-through duct of the axial impeller have three conjugated sections, viz., the cavitation, the pressure and the balancing ones, featuring an increasing angle of incidence of the impeller blades, said angle of blade incidence being bounded by the plane passing at right angles to the pump shaft, and by the plane tangential to the axial impeller blades, and an increasing diameter of the impeller hub, both said angle of blade incidence and said diameter of the impeller hub having the gradient variable along the impeller length in the meridional plane thereof, said gradient exhibiting its maximum value at the pressure section and the minimum value at the balancing section, whereas the blade channels are made flared, featuring the expansion angles (or angles of flare) of an equivalent diffuser whose one side is defined by the suction side of the impeller blade, and the other side, by the pressure side of the impeller blade, said diffuser expansion angles ranging within 1 to about 5 degrees.

Such a constructional arrangement of the axial impeller flow through duct makes it possible to provide a pump having high suction capacity and high efficiency. It is known commonly that in the case of a cavity flow the relative amount of hydraulic losses is substantially higher than that in the case of a cavity-free flow. The cavitation section of the axial impeller flow-through duct provides for attainment of a preset high pump suction capacity at a relatively low share of the head being established. The pressure section of the flow-through duct provides for the development of a preset head at minimum hydraulic losses therein, while the balancing section eliminates the radial helix-lead irregularity of the liquid flow at the axial impeller exit with the head thereon remaining nearly constant. Hence it ensues that the head increment along the axis of the axial impeller in the direction of the liquid flow proves to be nonuniform, featuring a variable gradient, i.e., a maximum one effective at the pressure section, and a minimum, on the balancing section. In order to provide the stall-free pattern of the liquid flow across the flow-through duct it is necessary that the angle of incidence of the impeller blades and the diameter of the impeller hub should vary likewise at a variable gradient in keeping with the above-mentioned principle of head variation. A specific feature inherent in the liquid-flow-through duct of the axial impeller in question, adapted for work at nominal ratings with low flow coefficient ($\phi<0.1$) and featuring a relatively higher density of the cascade of aerodynamic airfoils with a small amount of the blades, is a considerable length of the blade channels characterized by a substantial increase in the boundary layer thickness, its increasing tendency to separate and the resulting restriction of the limiting values of expansion angles of the equivalent diffuser of the blade channels.

That is why the twist of the impeller blades of the axial impeller flow-through duct lengthwise the impeller radius in each of the cross-sections thereof should obey the following formula:

$$r_i(tg\beta_i+a)=b \quad (4),$$

where $r_i$ is the running value of axial impeller radius;

$\beta_i$ is the running value of the angle of incidence of the impeller blades;

a, b are the constants assumed to be as follows:

(a) for the cavitation section of the axial impeller flow-through duct $$a=-(0.01 \text{ to } 0.15) \text{ to } +(0.01 \text{ to } 0.15)$$

$$b=(0.1 \text{ to } 0.3)\ R;$$

(b) for the pressure and the balancing sections of the axial impeller flow-through duct $$a=-(0.01 \text{ to } 0.6) \text{ to } +(0.01 \text{ to } 0.6)$$

$$b=(0.3 \text{ to } 1)R$$

where R is the axial impeller outside radius.

As a result the blade surface occurs to be a ruled one which adds to the production effectiveness of such an impeller. The values of the coefficients have been obtained as a result of theoretical research and estimation aimed at determining an optimum distribution of flow parameters both lengthwise the impeller and along the radius thereof. The twisting pattern of the impeller blades of the axial impeller flow-through duct eypressed in the relation (4) enables one to cover all known optimum laws of distribution of the flow velocity peripheral components lengthwise the impeller radius, viz., from the free-vortex to the solid-body principle, including the intermediate principles of flow velocity distribution, which provide for high pump efficiency. At the same time the relation (4) is instrumental in solving a number of problems concerned with the production process techniques of axial impellers.

Thus, for instance, axial impellers, wherein their liquid-flow-through duct is shaped according to the known relations, are usually produced by the mould-casting process which is a relatively labourious procedure when applied to manufacturing a small lot of impellers. In addition, cast axial impellers possess but relatively low strength characteristics and also suffer from too a large surface roughness of the impeller blades and from an inadequate accuracy of the latter.

The above-proposed relation (4) adopted for shaping the axial impellers enable up-to-date numerically controlled milling machines having high productivity to be used for their manufacture. Such production process techniques provide for high accuracy and strength of the impellers, high quality of their surface finish, i.e., low surface roughness of the impeller blades, and relatively low labour consumption when manufacturing small lot of impellers.

Moreover, one should take notice of the specific features inherent in the pump hydrodynamic characteristics, according to the present invention which reside in the presence of thick boundary layers in the blade channels due to a great length thereof, as well as in the effects produced upon the flow of liquid by the developed secondary flows and by the blade thickness.

The afore-enumerated specific features of the pump hydraulic performance involve more versatile shaping of the pump liquid-flow-through duct which is attained due to appropriately selecting the values of the constants "a" and "b" in the relation (4). The difference between the values of the constants "a" and "b" for the cavitation, the pressure and the balancing sections is accounted for by the difference between the optimum flow parameters effective at these sections. In particular, it is necessary to provide for an optimum distribution of the angles of attack along the blade radius, as well as optimum expansion angles of an equivalent diffuser of the blade channels, angles of blade incidence, etc. The twisting pattern of the pump flow-through duct blades, according to the invention provides for, in particular, the balancing of the flow parameters lengthwise the impeller radius at the exit thereof, which is necessary for reducing the hydraulic losses occurring in the discharge device.

The invention will be more clearly understood from the following description of some exemplary embodiments of a vane pump, to be had in conjunction with the accompanying drawings, wherein.

Figure 1:
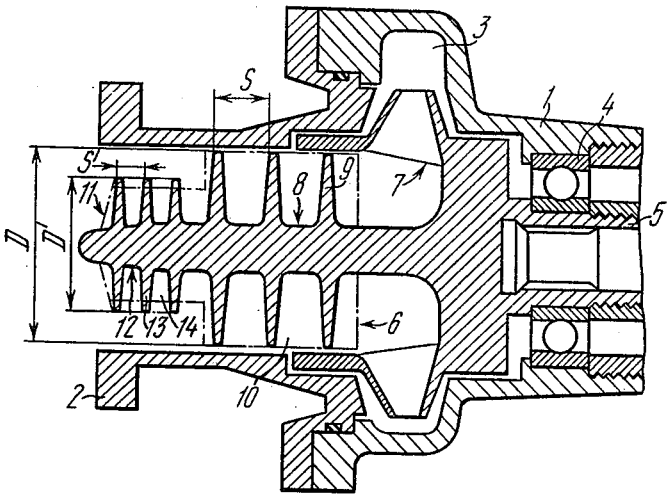
FIG. 1 is a diagrammatic longitudinal section view of a vane pump, according to the invention, shown in conjunction with a centrifugal impeller.

Referring now to the accompanying drawings, the pump comprises a housing 1 (FIG. 1) with a liquid inlet sleeve 2 and a liquid outlet shaped as a volute chamber 3. The housing 1 accommodates a drive shaft 5 resting upon bearings 4 and carrying an axial impeller 6 and a centrifugal impeller 7, arranged as along the direction of liquid flow. The axial impeller 6 has a hub 8 which carries impeller blades 9 defining blade channels 10 for the liquid to pass. The axial impeller 6 has an outside diameter D and a lead S of helix of the impeller blades at the entry thereof across its outside diameter D. The axial impeller 6 is provided with an additional intake axial impeller 11 set on the shaft 5 at the liquid admission end, said axial impeller 11 comprising a hub 12 and helical blades 13 made fast thereon to define blade channels 14. The additional intake impeller 11 has an outside diameter D' smaller than the outside diameter D of the axial impeller 6, while a lead S' of helix of the blades 13 is lower than the lead S of helix of the blades 9 at the exit of the axial impeller 6 across the outside diameter D thereof. The outside diameters D' and D and the leads S' and S of helix of the blades of the additional intake axial impeller 11 and of the axial impeller 6 are selected so as to provide for high pump suction capacity.

The pump represented in the accompanying drawing features the ratio between D' and D and that between S' and S approximately equal to 0.64 at a constant outside diameter of the additional intake axial impeller 11. Pumps of such a type have displayed the following experimental performance data that are tabulated below:

| Pump parameters Pump No | D'/D | C' | C | C/C' |
|---|---|---|---|---|
| 1 | 0.72 | 6200–7000 | 4700 | 0.76–0.675 |
| 2 | 0.64 | 7000–9000 | 5200 | 0.74–0.58 |
| 3 | 0.63 | 6000–8500 | 4500–5000 | 0.75–0.59 |
| 4 | 0.73 | 5500–7400 | 4500–5000 | 0.82–0.68 |

The findings obtained confirm the relation (2).

With the drive shaft 5 running the liquid is admitted along the inlet sleeve 2 to pass to the rotating intake impeller 11. Part of the liquid passes along the blade channels 14, while the other part of the liquid is fed to the rotating axial impeller 6 making its way through the clearance between the housing 1 and the blades 13 of the impeller 11. Mechanical interaction of the blades 13 and the liquid results in an increased suction head of the liquid admitted to pass to the axial impeller 6, wherein the liquid flows along the blade channels 10. Mechanical interaction between the blades 9 and the liquid brings about still higher suction head of the liquid which is then fed to the centrifugal impeller 7, while the liquid from the blade channels 10 of the axial impeller 6 is passed likewise to the centrifugal impeller 7, wherein the suction head of the liquid is increased to a required level. Such a successive increase in the suction head of the liquid provides for pump operation free from cavitation stalling of any pump impeller. Then the liquid is fed from the impeller 7 to the discharge device 3 and further on to the delivery line.

Figure 2:
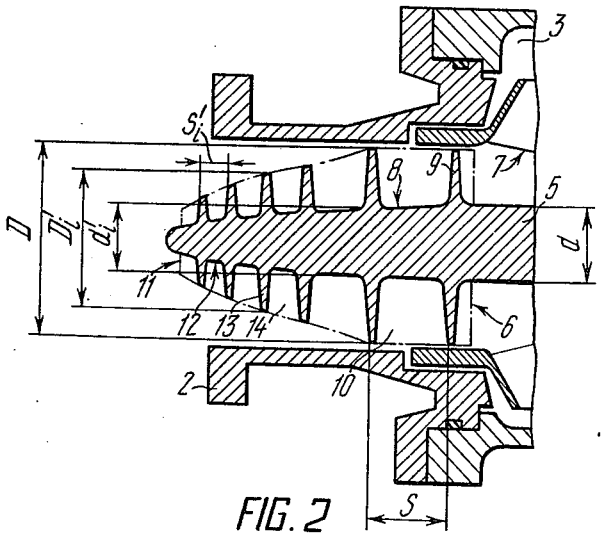
FIG. 2 is a longitudinal section view of an embodiment of an additional intake axial impeller, according to the invention.

FIG. 2 represents another embodiment of the pump, wherein the outside diameter $D_i'$ of the intake axial impeller 11 and the lead $S_i'$ of helix of the blades 13 thereof are made decreasing as against the direction of liquid flow. According to the principle of geometric similarity the lead $S_i'$ of helix of the blades 13 is selected in keeping with the relation (3) so as to suit the running values of the outside diameter $D_i'$ of the additional intake impeller 11 and of the diameter of the hub 12 thereof.

Pump operation in this case is similar to that of the pump illustrated in FIG. 1 with the exception that the required suction head is lower due to a smaller diameter of the additional intake axial impeller 11 at the entry thereof and that the pressure head is somewhat higher owing to a larger diameter of the additional intake axial impeller 11 at the exit thereof.

Thus, the above-mentioned shape of the meridional section of the additional intake axial impeller 11 provides for better suction capacity and more reliable pump operation free from cavitation stalling of the axial impeller 6, the centrifugal impeller 7, or the pump as a whole.

Figure 3:
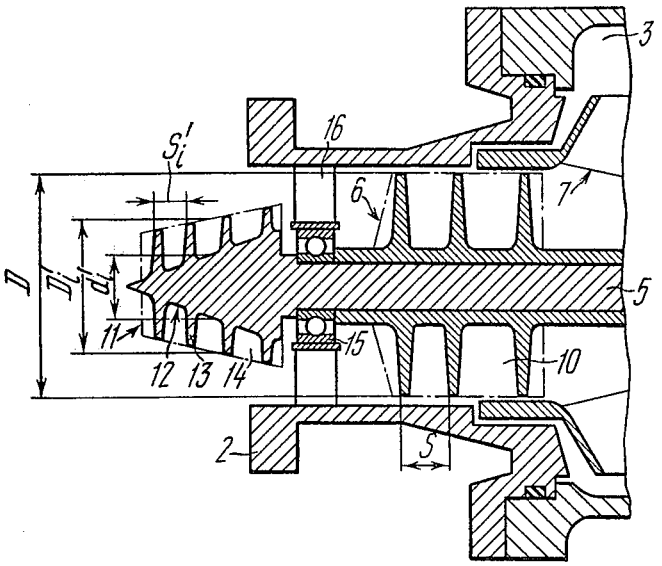
FIG. 3 is a longitudinal section view of a pump with a booster intake stage, shown in conjunction with a centrifugal impeller.

FIG. 3 illustrates a vane pump, wherein the additional intake axial impeller 11 is made use of in the booster stage. The impeller 11 is overhung on the rotatable drive shaft 5 supported by a bearing 15 which is located in a straightener 16 in between the intake axial impeller 11 and the axial impeller 6. The intake impeller 11 the dimensions conforming to the relation (3):

$$S_i' = (0.75 \text{ to } 1.25)\,\frac{D_i' + d_i'}{D + d} \cdot S.$$

The operation of the pump is similar to that of the pump represented in FIG. 2 with the exception that the flow velocity is reduced due to the provision of expansions in the blade channels of the straightener 16, while the static pressure of the liquid increases which improves the operating conditions of the axial impeller 6 without cavitation stalling thereof.

Application of the booster stage is especially reasonable when updating the existing pumps now in current use in order to increase the suction capacity thereof.

Figure 4:
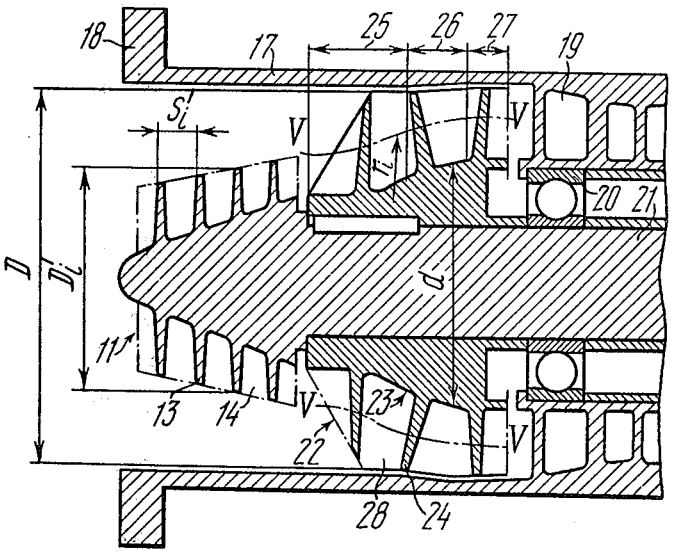
FIG. 4 is a longitudinal section view of a vane pump with an axial impeller, according to the invention.

A vane pump shown in FIG. 4 has a housing 17 with a liquid inlet nozzle 18 and a liquid outlet 19. The housing 17 accommodates a drive shaft 21 journalled in bearings 20 and carrying in the direction of the liquid flow the additional intake axial impeller 11 and an axial impeller 22 which has a hub 23 whose diameter increases at a gradient variable lengthwise the impeller 22 in the meridional plane thereof. The hub 23 carries helical impeller blades 24 featuring the increasing angles ($\beta$) of incidence thereof, said angles having a gradient variable along the impeller length. The angle ($\beta$) of incidence of the blades 24 is bounded by the plane passing normally to the pump shaft 21 and the plane tangential to the impeller blades 24.

The liquid flow-through duct of the impeller 22 has three conjugated sections, viz., a cavitation section 25, a pressure section 26 and a balancing section 27. The liquid flow passing through the cavitation section 25 of the flow-through duct is directed axially so as to ensure the required pump suction capacity, whereas said liquid flow passing through the pressure section 26 of the flow-through duct is directed obliquely so as to provide for the required pump pressure head, and while passing through the balancing section 27 of the flow-through duct the liquid flow is directed axially again so as to eliminate radial and helix-lead nonuniformity thereof at the exit of the axial impeller 22 at an approximately constant pressure head therein.

The gradient of the diameter of the hub 23 and of the angle ($\beta$) of incidence of the impeller blades 24 features its maximum value at the pressure section 26 and a minimum value at the balancing section 27.

Figure 5:
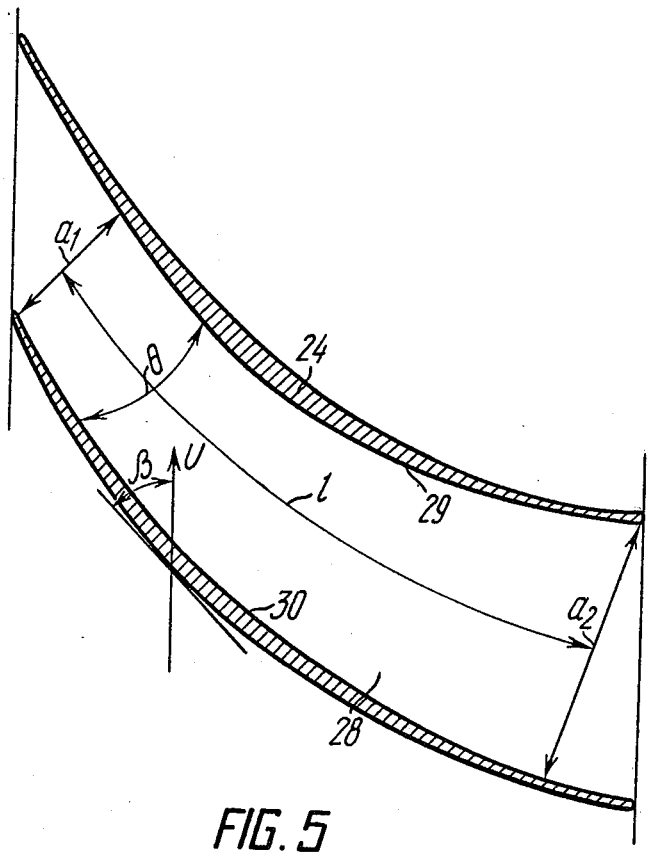
FIG. 5 is a scaled-up view of a developed cylindrical section taken along the curved generating line V—V in FIG. 4.

The helical blades 24 define blade channels 28 (FIG. 5) which are made flared with expansion angles ($\theta$) of an equivalent diffuser whose one side is defined by a suction side 29 of the impeller blade 24, while the other side, by a pressure side 30 of the impeller blade 24, the angle $\theta$ ranging from 1 to about 5 degrees. The aforesaid magnitudes of the equivalent diffuser expansion angles have been derived from the relation:

$$\theta = 2 \operatorname{arctg} \frac{a_2 \frac{C_{1a}}{C_{2a}} - a_1}{2\,l} \tag{5}$$

where $a_1$ and $a_2$ stand for the width of the blade channel 28 measured normally to its centre line at the entry and the exit thereof, respectively;

$C_{1a}$ and $C_{2a}$ stand for the value of the axial component of an absolute flow velocity at the entry and the exit of the axial impeller, respectively;

1 is the length of the blade channel 28 measured along the centre line thereof from the section where the channel width is equal to $a_1$ to the section where its width equals $a_2$.

The angle $\beta$ is bounded by the vector of the peripheral speed U at the running point of the blade 24 and the tangent line drawn to that point.

The twist pattern of the impeller blades 24 (FIG. 4) of the flow-through duct of the axial impeller 22 along the radius thereof at each of its cross sections obey the following equation:

$$r_i(tg\beta_i+a)=b \quad (4),$$

where $r_i$ is the running value of the radius of the axial impeller 22;

$\beta_i$ is the running value of the angle of incidence of the impeller blades 22 of the axial impeller;

a,b are the constants assumed to be, for the flow-through duct cavitation section 25, equal to:

$$a=(0.01 \text{ to } 0.15) \text{ to } +(0.01 \text{ to } 0.15);$$

$$b=(0.1 \text{ to } 0.3)R;$$

and for the pressure section 26 and the balancing section 27 of the axial impeller flow-through duct to be as follows:

$$a=-(0.01 \text{ to } 0.6) \text{ to } +(0.01 \text{ to } 0.6);$$

$$b=(0.3 \text{ to } 1)R$$

where R is the axial impeller outside radius.

The aforesaid principle of twisting the blades 24 of the axial impeller 22 is realized when manufacturing said impeller on modern highly productive numerically controlled milling machines, with the result that the surface of the blades 24 occurs to be of the ruled design which adds to the blade strength and to higher accuracy of reproduction of their geometric shape. Application of the relation (4) enables one to cover all known optimum laws of distribution of the peripheral components of the liquid flow absolute velocity lengthwise the radius of the impeller 22, viz., from that approximating the free-vortex principle up to that approximating the solid-body principle, including the intermediate principles of flow velocity distribution, which provide for high pump efficiency. The values of the constants "a" and "b" in the relation (4) governing the principle of blade twisting make for the effect of the boundary layers that are liable to arise in the blade channels, on the wall of the housing 17 and on the axial impeller hub 23, as well as the effect of the thickness of the blades 24, said values of said constants being derived by way of experiments and estimation.

With the pump drive shaft 21 (FIG. 4) rotating and, hence, with the additional intake axial impeller 11 and the axial impeller 22 set on said shaft, rotating likewise, the liquid being handled is admitted, along the inlet sleeve 18, to pass to the helical blades 13, flow along the blade channels 14 and through the clearance defined by the wall of the pump housing 17 and the outside of the impeller 11 and get onto the helical blades 24, from whence the liquid passes along the blade channels 28 to the pump discharge device 19. Mechanical interaction between the blades 13 of the intake impeller 11 and the liquid being handled results in an increased suction head of the liquid delivered to the axial impeller 22. When the liquid flows along the cavitation section 25 of the flow-through duct of the impeller 22, a flow separation cavity occurs on the suction side 29 (FIG. 5) of the blades 24, said cavity spreading from the blade leading edge over a length approximately equal to the blade circular pitch. It is due to the preselected magnitude of the angle $\beta$ of incidence of the blades 24 that the boundary of the flow separation cavity runs closely to the suction surface of the blade suction side 29 without contacting said surface, whereby the height of said cavity is minimized and the hydraulic losses across the cavitation section 25 (FIG. 4) are reduced, with the high suction capacity of the impeller 22 remaining unaffected. When the liquid flows along the pressure section 26, the flow turbulent zone effective past the separation cavity gets mixed with the flow core, and the flow is turned in an oblique direction. It is due to the provision of the specially shaped blade channels 28 and the hub 23 that the separation- and cavitation-free flow of liquid along the pressure section of the impeller 22 is attained.

When passing along the balancing section 27 the liquid flow resumes axial direction so that its helix-lead and radial nonuniformity is eliminated.

What is claimed is:

1. An axial or worm type centrifugal impeller pump, comprising: a housing; a drive shaft running through said housing; bearings in which said drive shaft is rotatably journalled; an axial impeller mounted on said drive shaft; a hub of said axial impeller; helical blades of said axial impeller fixed on said hub, said blades defining a plurality of blade channels for the liquid being handled to pass; an additional intake axial impeller mounted on said drive shaft forwardly of said axial impeller as viewed along the flow of liquid; a hub of said additional intake axial impeller; helical impeller blades fixed on said hub of said additional intake axial impeller; the outer diameter and the lead of the helix of said helical impeller blades of said additional intake axial impeller being synchronously and correspondingly smaller than the outside diameter and the lead of helix of said helical impeller blades of said axial impeller at the entry thereof; the ratio between the outside diameters of said additional intake axial impeller and said axial impeller as well as the ratio between the leads of helix of said impeller blades of said additional intake axial impeller and said axial impeller across the outside diameters of said respective impellers being selected so as to provide for high pump suction capacity.

2. A pump as claimed in claim 1, wherein said additional intake axial impeller is made use of in the booster stage.

3. A pump as claimed in claim 1, wherein the flow-through duct of said axial impeller has three conjugated sections, viz., a cavitation, a pressure and a balancing ones, said sections featuring an increasing angle of incidence of said helical impeller blades, said angle being bounded by the plane passing at right angles to said pump drive shaft and by the plane tangential to said helical impeller blades of the axial impeller, and an increasing diameter of said hub, both said angle of blade incidence and said diameter of the impeller hub having a gradient variable along the length of said axial impeller in the meridional plane thereof in such a manner that said gradient features its maximum value at said pressure section and a minimum value at said balancing section, whereas said blade channels are made flared with the expansion angles of an equivalent diffuser whose one side is defined by the suction side of the impeller blade and the other side, by the pressure side of the impeller blade, said expansion angles varying from 1 to about 5 degrees.

4. A pump as claimed in claim 3, wherein the twist pattern of said impeller blades of the flow-through duct of said axial impeller lengthwise the radius of said impeller in each of the cross sections thereof, obeys the following relation:

$$r_i(tg\beta_i+a)=b,$$

where $r_i$ is the running value of said axial impeller;

$\beta_i$ is the running value of the angle of incidence of said impeller blades;

a,b are the constants which, for said cavitation section of the flow-through duct of said axial impeller, are as follows:

$$a=-(0.01 \text{ to } 0.15) \text{ to } +(0.01 \text{ to } 0.15)$$

$$b=(0.1 \text{ to } -0.3)\,R$$

and for said pressure and said balancing sections of the flow-through duct of said axial impeller, are as follows:

$$a=-(0.01 \text{ to } 0.6) \text{ to } +(0.01 \text{ to } 0.6)$$

$$b=(0.3 \text{ to } 1)R$$

where R is the outside radius of said axial impeller.

5. A pump as claimed in claim 1, wherein the outside diameter of said additional intake axial impeller has a constant length in the meridional plane and is by 10 to 50 percent smaller than the outside diameter of said axial impeller, and the lead of helix of said impeller blades of the additional intake axial impeller is by 10 to 50 percent lower than the lead of helix of said impeller blades of the axial impeller at the entry thereof.

6. A pump as claimed in claim 5, wherein said additional intake axial impeller is made use of in the booster stage.

7. A pump as claimed in claim 6, wherein the liquid flow-through duct of said axial impeller has three conjugated sections, viz., a cavitation, a pressure and a balancing ones, said sections featuring an increasing angle of incidence of said helical impeller blades, said angle being bounded by the plane passing at right angles to said pump drive shaft and by the plane tangential to said helical impeller blades of the axial impeller, and an increasing diameter of said hub, both said angle of blade incidence and said diameter of the impeller hub having a gradient variable along the length of said axial impeller in the meridional plane thereof in such a manner that said gradient features its maximum value at said pressure section and a minimum value at said balancing section, whereas said blade channels are made flared with the expansion angles of an equivalent diffuser whose one side is defined by the suction side of the impeller blade and the other side, by the pressure side of the impeller blade, said expansion angles varying from 1 to about 5 degrees.

8. A pump as claimed in claim 7, wherein the twist pattern of said impeller blades of the flow-through duct of said axial impeller lengthwise the radius of said impeller in each of the cross sections thereof, obeys the following relation:

$$r_i(tg\beta_i+a)=b,$$

where $r_i$ is the running value of said axial impeller;

$\beta_i$ is the running value of the angle of incidence of said impeller blades;

a,b are the constants which, for said cavitation section of the flow-through duct of said axial impeller, are as follows:

$$a=(0.01 \text{ to } 0.15) \text{ to } (0.01 \text{ to } 0.15)$$

$$b=(0.1 \text{ to } 0.3)R$$

and, for said pressure and balancing sections of the flow-through duct of said axial impeller, are as follows:

$$a=-(0.01 \text{ to } 0.6) \text{ to } +(0.01 \text{ to } 0.6)$$

$$b=(0.3 \text{ to } 1)R$$

where R is the outside radius of said axial impeller.

9. A pump as claimed in claim 1, wherein the outside diameter of said additional intake axial impeller and the lead of helix of said impeller blades of the additional intake axial impeller decrease along the length thereof in the meridional plane as against the flow of liquid.

10. A pump as claimed in claim 9, wherein the lead of helix of said helical impeller blades of the additional intake axial impeller is selected to suit the following relation:

$$S_i' = (0.75 \text{ to } 1.25)\frac{D_i' + d_i'}{D + d} \cdot S$$

where $S_i'$, $D_i'$, $d_i'$ are the running values of the lead of helix of said impeller blades, of the outside diameter and the diameter of said hub of said additional intake axial impeller, respectively;

S, D, d are the values of the lead of helix of said impeller blades, of the outside diameter, and the diameter of said hub of said axial impeller at the entry thereof, respectively.

11. A pump as claimed in claim 10, wherein said additional intake axial impeller is made use of in the booster stage.

12. A pump as claimed in claim 11, wherein the liquid flow-through duct of said axial impeller has three conjugated sections, viz., a cavitation, a pressure, and a balancing ones, said sections featuring an increasing angle of incidence of said helical impeller blades, said angle being bounded by the plane passing at right angles to said pump drive shaft and by the plane tangential to said helical impeller blades of the axial impeller, and an increasing diameter of said hub, both said angle of blade incidence and said diameter of the impeller hub having a gradient variable along the length of said axial impeller in the meridional plane thereof, in such a manner that said gradient features its maximum value at said pressure section and a minimum value at said balancing section, whereas said blade channels are made flared with the expansion angles of an equivalent diffuser whose one side is defined by the suction side of the impeller blade and the other side, by the pressure side of the impeller blade, said expansion angles varying from 1 to about 5 degrees.

13. A pump as claimed in claim 12, wherein the twist pattern of said impeller blades of the flow-through duct of said axial impeller lengthwise the radius of said impeller in each of the cross sections thereof, obeys the following relation:

$$r_i \cdot (tg\beta_i + a) = b,$$

where $r_i$ is the running value of said axial impeller;

$\beta_i$ is the running value of the angle of incidence of said impeller blades;

a,b are the constants which for said cavitation section of the flow-through duct of said axial impeller, are as follows:

$$a = -(0.01 \text{ to } 0.15) \text{ to } +(0.01 \text{ to } 0.15)$$

$$b = (0.1 \text{ to } 0.3)R$$

and for said pressure and said balancing sections of the flow-through duct of said axial impeller, are as follows:

$$a = -(0.01 \text{ to } 0.6) \text{ to } -(0.01 \text{ to } 0.6)$$

$$b = (0.3 \text{ to } 1)R$$

where R is the outside radius of said axial impeller.

* * * * *